US010124363B2

(12) United States Patent
Ichizawa

(10) Patent No.: US 10,124,363 B2
(45) Date of Patent: Nov. 13, 2018

(54) SHOWER HEAD CAPABLE OF PROVIDING SHOWER FEELING WITHOUT WATER SPRAY PLATE

(71) Applicant: micro-bub Corporation, Tokyo (JP)

(72) Inventor: Junichi Ichizawa, Tokyo (JP)

(73) Assignees: MICRO-BUB CORPORATION, Tokyo (JP); TOPLE CO., INC., Osaka (JP)

( * ) Notice: Subject to any disclaimer, the term of this patent is extended or adjusted under 35 U.S.C. 154(b) by 0 days.

(21) Appl. No.: 15/379,814

(22) Filed: Dec. 15, 2016

(65) Prior Publication Data

US 2017/0157635 A1 Jun. 8, 2017

Related U.S. Application Data

(63) Continuation of application No. PCT/JP2015/067308, filed on Jun. 16, 2015.

(30) Foreign Application Priority Data

Jun. 16, 2014 (JP) ..... 2014-123636

(51) Int. Cl.

| | |
|---|---|
| ***B05B 1/18*** | (2006.01) |
| ***B05B 1/34*** | (2006.01) |
| ***E03C 1/04*** | (2006.01) |
| ***B05B 15/62*** | (2018.01) |

(52) U.S. Cl.

CPC ..... *B05B 15/62* (2018.02); *B05B 1/341* (2013.01); *E03C 1/0408* (2013.01)

(58) Field of Classification Search

CPC ..... B05B 1/3405; B05B 1/341; B05B 1/18; B05B 1/185; B05B 15/061; B05B 15/62; E03C 1/0408; E03C 1/0409

See application file for complete search history.

(56) References Cited

U.S. PATENT DOCUMENTS

| | | | | |
|---|---|---|---|---|
| 4,497,444 A * | 2/1985 | Arnold | B05B 15/654 | 239/472 |
| 6,027,044 A * | 2/2000 | Hirata | B05B 1/3006 | 239/428.5 |
| 7,364,097 B2 * | 4/2008 | Okuma | B05B 1/18 | 239/525 |
| 2014/0151470 A1 * | 6/2014 | Katou | B01F 5/0663 | 239/589 |

* cited by examiner

*Primary Examiner* — Darren W Gorman
(74) *Attorney, Agent, or Firm* — Westerman, Hattori, Daniels & Adrian, LLP

(57) ABSTRACT

A shower head includes a body including a head unit and a tap water flow path. The head unit has one end connected with a hose through which water flows and an opening formed at the other end. A bottom plate is fixed inside the head unit and including a hole at a central part. A micro bubble generator is placed on the bottom plate and including a micro bubble generating path inside. A tornado plate is positioned between the bottom plate and the micro bubble generator and including an eccentric hole configured to achieve an increased flow speed by swirling the water. A pressing plate houses the micro bubble generator and is fixed inside the head unit together with the bottom plate. A tubular cap is fitted to the opening of the head unit and housing the micro bubble generator inside.

4 Claims, 12 Drawing Sheets

[Fig. 1]
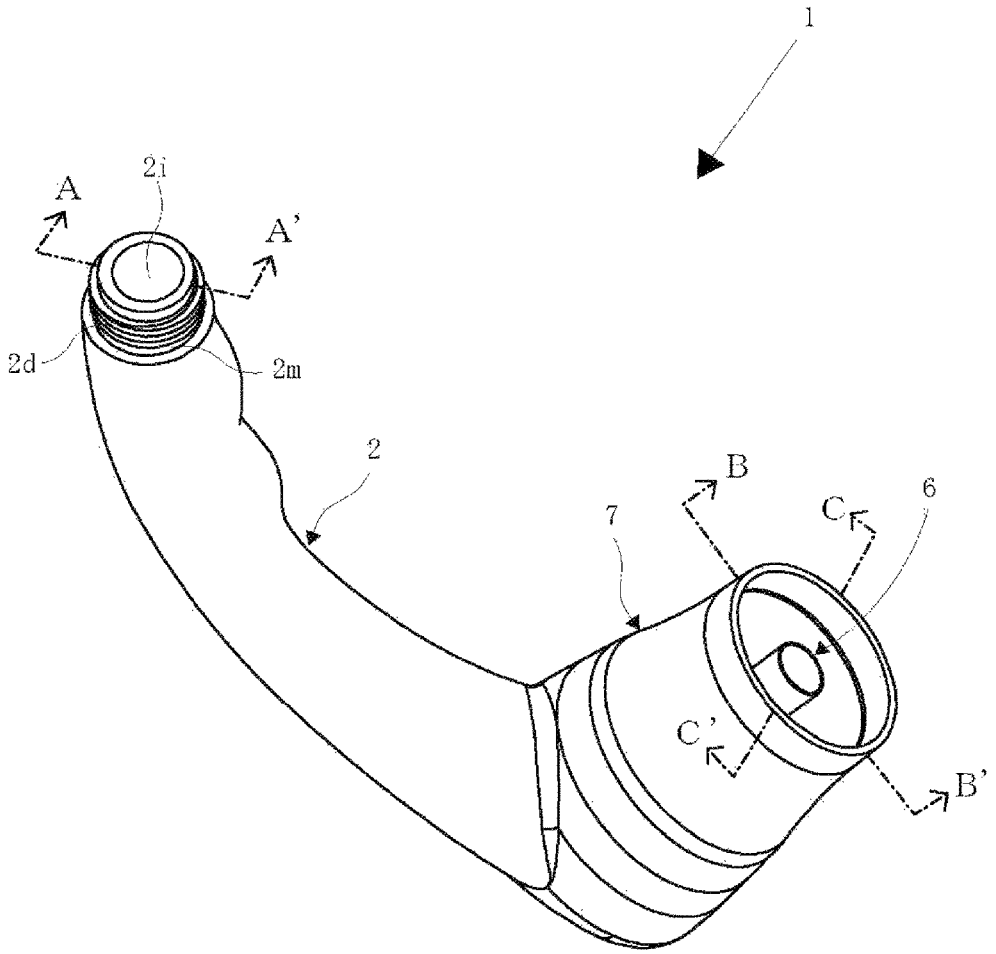

[Fig. 2]
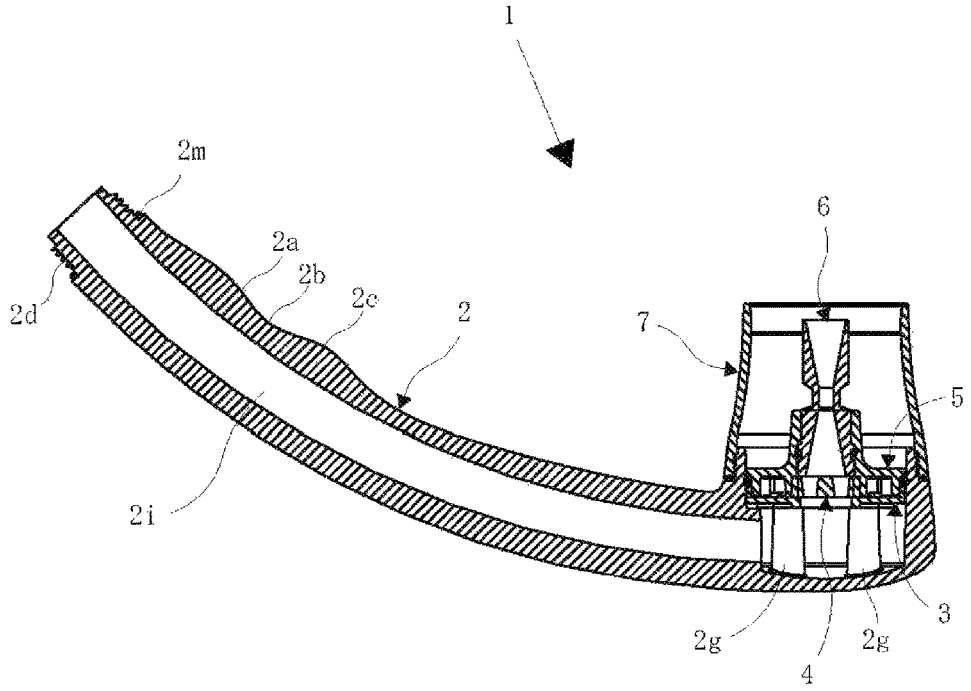

[Fig. 3]
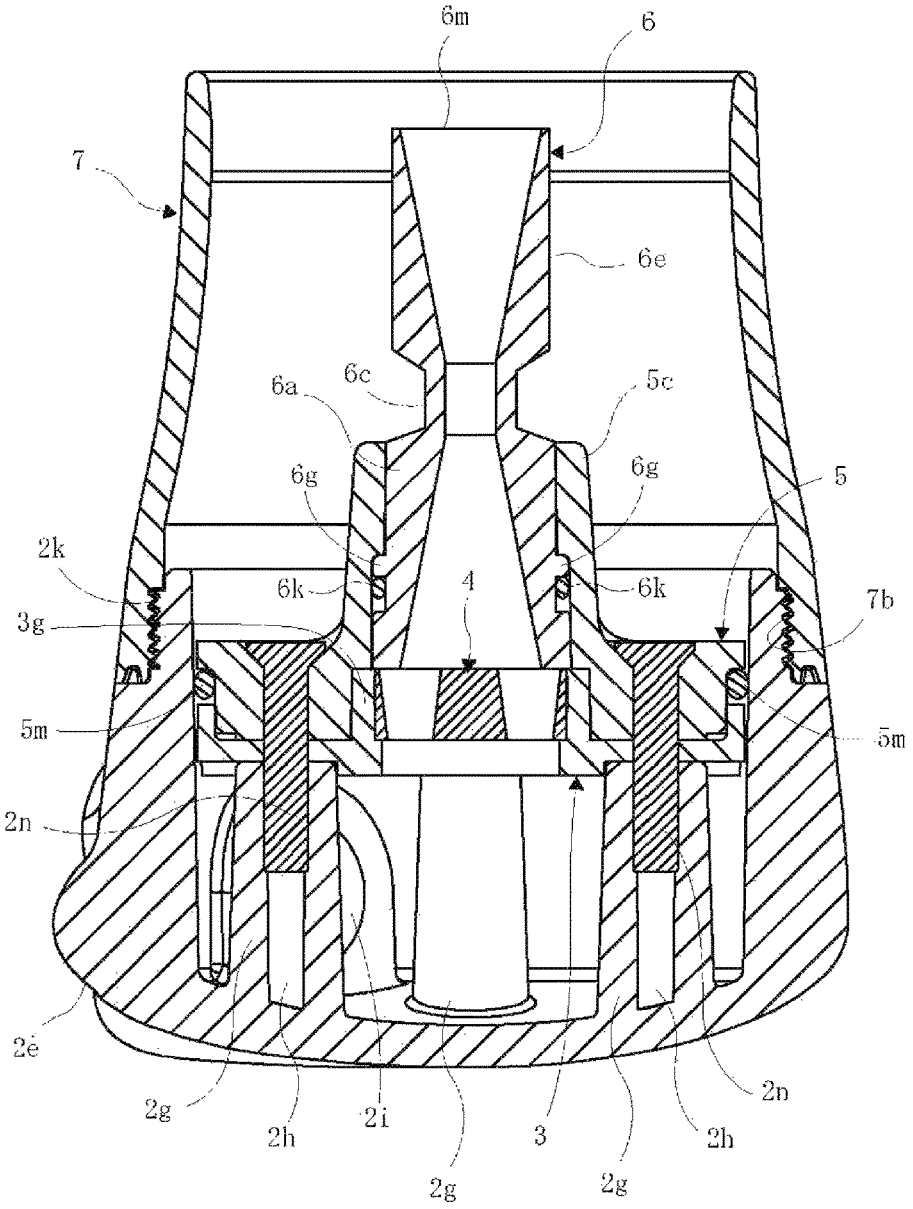

[Fig. 4]
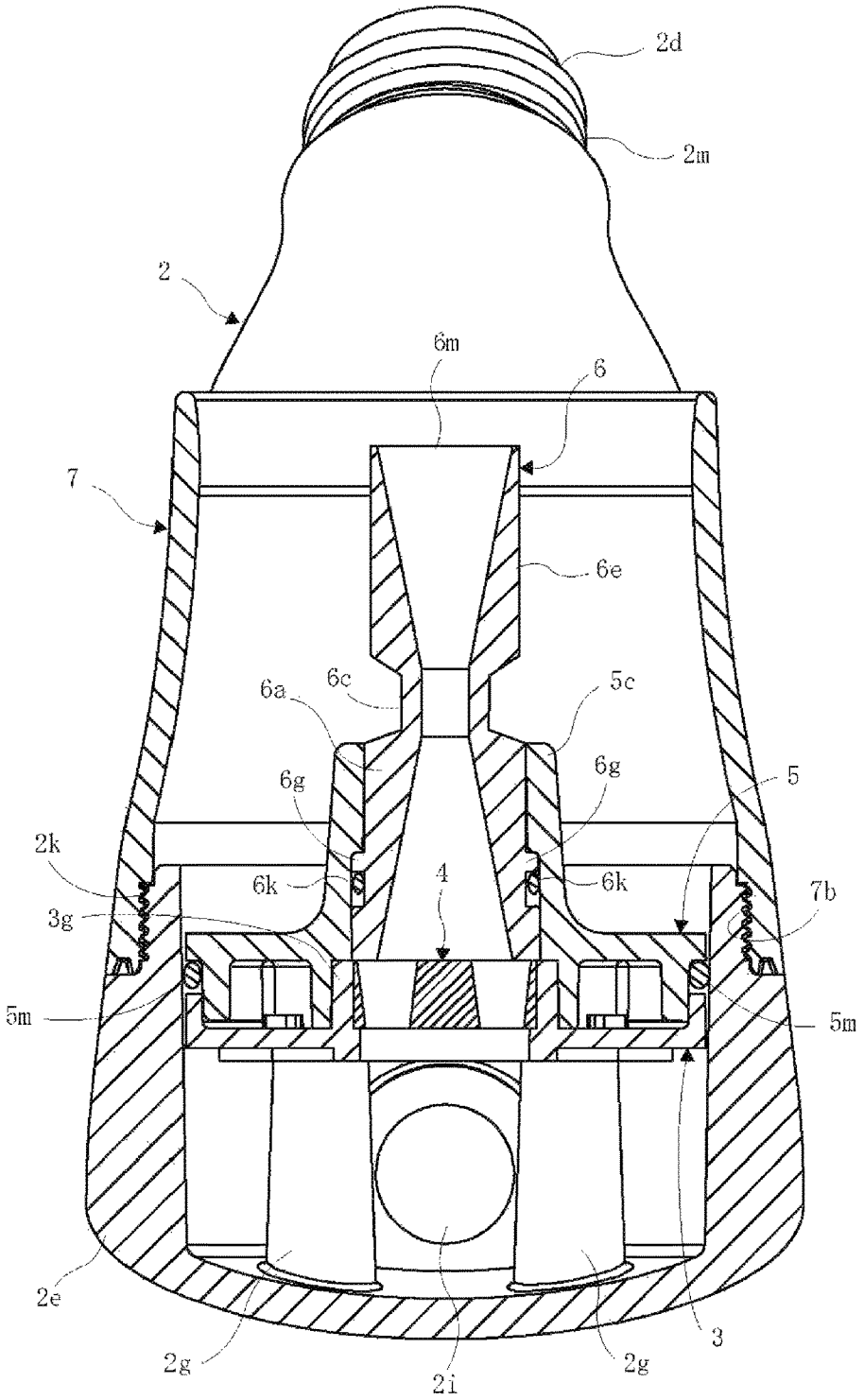

SHOWER HEAD CAPABLE OF PROVIDING SHOWER FEELING WITHOUT WATER SPRAY PLATE

TECHNICAL FIELD

The present invention relates to a shower head capable of providing a shower feeling without a water spray plate, configured to generate micro bubbles from tap water, and having a micro bubble generating structure.

BACKGROUND ART

Study on micro bubbles started around 1985 . Micro bubbles belong to a new technological field, and have a large number of features to be revealed. Currently, the following three phenomena of micro bubbles are known.

One phenomenon is that each micro bubble, which has a small size, enters deep inside, for example, a web of fibers or a pore, and pushes out any clogging dirt.

The second phenomenon is that, when discharged into water, micro bubbles are pressed under water pressure to become further smaller nano bubbles. Micro bubbles in liquid disappear or turn into nano bubbles in 30 to 60 seconds approximately. Having turned into nano bubbles, the bubbles stay in the liquid for several hours to several days.

The third phenomenon is pressurized breakdown. Pressurized breakdown is a phenomenon that, when discharged into water, a micro bubble is pressed down under water pressure and turned into a nano bubble smaller than the micro bubble, and eventually, the nano bubble has an internal air pressure of 300 atm approximately and breaks down. It is thought that, before this pressurized breakdown, ultrasonic at 400 kilometers per hour approximately, and heat at high temperature near 5500° C. are generated. Then, it is thought that a synergistic effect of these three phenomena allows easy removal of, for example, dirt.

Six known schemes for generating micro bubbles include, for example, a fast shearing scheme, a pressurized breakdown scheme, and a cavitation scheme. Most of the schemes suck external air using, for example, an aspirator, or perform forced injection thereof.

Patent Literature 1 discloses a shower head not including a water spray plate. Patent Literature 1, which is a patent application by the inventor, is a water discharging port unit that can achieve water discharge in a spray form to provide a desirable shower feeling without a water spray plate and can be attached to an end of a shower hose. A flow speed is increased through a narrowed water passage according to a principle of a rubber hose. Before this, a member for causing flowing water to generate swirling flow is incorporated at an entrance of the water passage to increase the flow speed. Then, the flow speed is further increased through a narrowed part of the water passage, which gradually decreases in size to twist the water flow. This flowing water is abruptly discharged in a spray form at the water discharging port unit. In this manner, the disclosed shower water discharging port can provide a desirable shower feeling without a water spray plate.

Patent Literature 1 discloses the structure including no water spray plate but has no description of micro bubbles. The disclosure is a simple tubular object including a first component and a second component connected with a leading end of a hose, but not having the shape of a typical shower head, which makes it difficult to hold the tubular object as a shower head. Thus, the tubular object can cause injury by hitting the head of a user, or can be damaged by dropping, for example.

CITATION LIST

Patent Literature

[Patent Literature 1]
Japanese Patent Laid-Open No. 2011-183125

SUMMARY OF INVENTION

Technical Problem

The present invention is intended to provide a shower head capable of providing a shower feeling without a water spray plate, and configured to effectively generate micro bubbles, provide a shower feeling, and easy to hold.

Solution to Problem

To solve the above-described problem, the present invention provides:

(1) A shower head capable of providing a shower feeling without a water spray plate, the shower head including:

a body that includes a head unit having one end connected with a hose through which tap water flows and including an opening formed at the other end, includes a flow path through which tap water flows, and is held by a hand;

a bottom plate fixed inside the head unit and including a drilled hole at a central part;

a micro bubble generator placed on the bottom plate and including a micro bubble generating path formed inside;

a tornado plate positioned between the bottom plate and the micro bubble generator and including an eccentric hole configured to achieve an increased flow speed by swirling the tap water;

a pressing plate housing the micro bubble generator and fixed inside the head unit together with the bottom plate; and a tubular cap fitted to the opening of the head unit and housing the micro bubble generator inside.

(2) The shower head capable of providing a shower feeling without a water spray plate according to (1), in which the cap has a length longer than the length of the micro bubble generator.

(3) The shower head capable of providing a shower feeling without a water spray plate according to (1) or (2), in which:

the micro bubble generator includes:

a first cylindrical portion housed in a hole of the pressing plate, and including a first flow path having an inner diameter gradually decreasing toward a central part from an end part through which the tap water enters, and provided with, on an outer circumferential surface, a second ridge at the end part, a first ridge closer to the central part than the second ridge, and a groove as a recess between the second ridge and the first ridge;

a second cylindrical portion including a second flow path connected with the first flow path; and a third cylindrical portion including a third flow path connected with the second flow path and having an inner diameter gradually increasing toward an end part through which the tap water exits, the end part serving as a spray nozzle through which the tap water is discharged as a shower, the first ridge is locked inside the pressing plate, the groove is provided with a packing, and a gap between the pressing plate and the micro bubble generator is sealed.

(4) The shower head capable of providing a shower feeling without a water spray plate according to any one of (1) to (3), in which:

the bottom plate includes a disk-shaped bottom part, a tubular inner rim erected on an upper surface of the bottom part and including a flow path at a central part and a stepped portion inside, and an outer rim erected on an outer periphery of the bottom part, and an end part of the micro bubble generator is positioned between the inner rim and the outer rim, and the tornado plate is fitted inside the flow path and locked by the stepped portion.

(5) The shower head capable of providing a shower feeling without a water spray plate according to any one of (1) to (4), in which the tornado plate is fixed in position by being pressed by a second ridge end part of the micro bubble generator.

According to Bernoulli's principle, it has been known that cavitation occurs as water flows a narrowed path that gradually expands. However, it has been thought that a device having such a configuration cannot generate a desirable amount of micro bubbles under conditions of a water-supply pipe diameter and a water-supply pressure of a general household water pipe, and the device has not been commercialized.

In addition, it has been thought that generation of micro bubbles requires intake of external air and pressurization of the air under conditions of a diameter of 13 mm and a water supply pressure of 0.1 MPa of a general household water pipe.

A method of generating micro bubbles from typical tap water was studied. In the method, a micro bubble generation path is formed somewhere on the path of a water supply pipe or an internal pipe. The micro bubble generation path has an inner diameter decreasing from an entrance side in a narrowing circular cone shape and then gradually increasing again in an opening circular cone shape. The tap water turned into swirling flow is caused to flow through the micro bubble generation path to generate cavitation, and negative pressure of the cavitation is used to generate micro bubbles.

As a result, it was confirmed that, under conditions of a water pipe diameter of 15 A (13 mm) and a water-supply pressure of 0.1 MPa approximately, and air-containing typical tap water, micro bubbles were generated through the shape of the circular cones connected at leading end parts. Accordingly, the invention disclosed by Patent Literature 1 was completed. The shape of the micro bubble generation path does not need to be vertically symmetric. The invention of Patent Literature 1 has been further developed to achieve the invention of the present application.

The micro bubble generation path used in the study was a brass machined product, but may be made of, for example, resin, various kinds of metal, or ceramic as long as the accuracy is maintained. Two horn-shaped tubes may be produced and connected with each other at blowing holes of the horns. Alternatively, a horn-shaped structure may be formed and connected with a water supply pipe by screwing. Alternatively, the structure may be integrally formed with the water supply pipe. Alternatively, the micro bubble generation path may be formed from a water supply pipe by narrowing part thereof. The micro bubble generation path may be provided in any method.

It is expected that, for example, when connected with a water supply pipe or an elbow having a different diameter, a typical water pipe can cause turbulence at a connected part and generate air bubbles due to cavitation. However, it is assumed that, with, for example, a simple connection step of a normal water supply pipe, only a small amount of micro bubbles is generated and also each air bubble has a large diameter. Generation of a desirable amount of micro bubbles having desirable diameters is confirmed only when a designed micro bubble generating path is provided in a water pipe.

In a micro bubble generation path in a micro bubble generator 6, the generation amount of micro bubbles increases as the water-supply pressure increases. However, at the pressure (0.1 to 0.5 MPa approximately) of a general household water pipe, the micro bubble generator 6 can generate a sufficient amount of micro bubbles having sufficient diameters. The pressure can be increased when a water transferring pipe provided with the micro bubble generator has a large diameter, and can be decreased when the water transferring pipe has a small diameter. When the pressure of liquid fluid is low at 0.1 to 0.15 MPa or high at 0.4 to 0.5 MPa approximately, micro bubbles can be still generated sufficiently.

The present description is made on generation of micro bubbles with typical tap water, but liquid flowing through the water transferring pipe is not limited to tap water.

When the liquid flowing through the water transferring pipe contains a smaller amount of air, a smaller amount of micro bubbles is generated. When the liquid flowing through the water transferring pipe contains no gas, no micro bubbles are generated. In these cases, the liquid can be turned into liquid that can generate micro bubbles by mixing the liquid with gas before the liquid passes through the micro bubble generator.

The amount of contained air decreases at higher water supply temperature, but the generation amount of micro bubbles increases near a certain temperature, probably because the contained air (dissolved air) is in an unstable state. When hot water and cold water are mixed, micro bubbles are further generated. For example, water at 40° C. as a mixture of hot water at 60° C. and cold water at 10° C. is preferable.

In the micro bubble generation path in the micro bubble generator 6 according to the present invention, the generation amount of micro bubbles is affected also by the amount of contained air provided during water supply. However, a sufficient amount of micro bubbles having sufficient diameters can be generated from tap water supplied to a general house (tap water not subjected to pressurization and air injection than normal, and containing naturally dissolved air).

Advantageous Effects of Invention

Similarly to the conventional shower head, the present invention includes a holding unit 2*a* and thus is easy to hold. The micro bubble generator 6 is fixed to a head unit 2*e* by a bottom plate 3 and pressing plate 5, and thus the present invention is easy to assemble. Since the present invention includes the micro bubble generator 6, micro bubbles can be generated from tap water. Water is discharged from a spray nozzle 6*m* in a shower or spray form along the shapes of a tornado plate 4 and micro bubble generator 6. When no water spray plate is provided, a shower feeling can be obtained without worry of clogging of holes of the water spray plate.

Without a water spray plate, the conventional shower head cannot discharge water in a shower form. For this reason, a water spray plate is attached thereto, but maintenance is needed due to clogging of, for example, dirt in a hole of the water spray plate. In particular, the hole clogging of the water spray plate of a shower head at a public bath place, which is used by many and unspecified people, is a large load on maintenance of the place. A shower head that does not need a water spray plate plays an important role in reduction of such a load.

The shower head according to the present invention turns incoming water into swirling flow near the entrance of the micro bubble generation path, so that water discharged from the micro bubble generation path expanding in a horn shape spreads in a spray form while rotating. In this manner, a desirable shower feeling can be provided without a water spray plate, and in a case of low water pressure, a shower feeling stronger than conventionally obtained can be obtained due to no pressure drop of the discharged water caused by a water spray plate.

In the market, some products achieve improvement of degraded shower feeling due to a pressure drop caused by a water spray plate, by increasing a shower speed with reduced sizes of holes of a water spray plate. When the hole size is reduced, however, the frequency of clogging is adversely increased.

Since shower at high water supply pressure causes a painful shower feeling without a water spray plate, the shower head according to the present invention has a structure that allows attachment of a water spray plate. The water spray plate may be connected by screwing or fitted to an end part of a cap.

A cap 7 is provided and the micro bubble generator 6 is entirely housed in the cap 7, so that it is possible to prevent injury of the head of a user, damage on the micro bubble generator 6 by dropping, or the like.

Packings 5*m* and 6*k* are provided to seal gaps with the micro bubble generator 6 so that all of tap water can flow through the micro bubble generator 6, thereby preventing a loss of the water transferring pressure through a flow path.

BRIEF DESCRIPTION OF DRAWINGS

FIG. 1 is a perspective view of a shower head including no water spray plate according to the present invention.

FIG. 2 is a sectional view taken along line A-A' in FIG. 1.

FIG. 3 is an enlarged sectional view taken along line B-B' in FIG. 1.

FIG. 4 is an enlarged sectional view taken along line C-C' in FIG. 1.

DESCRIPTION OF EMBODIMENTS

Figure 5A:
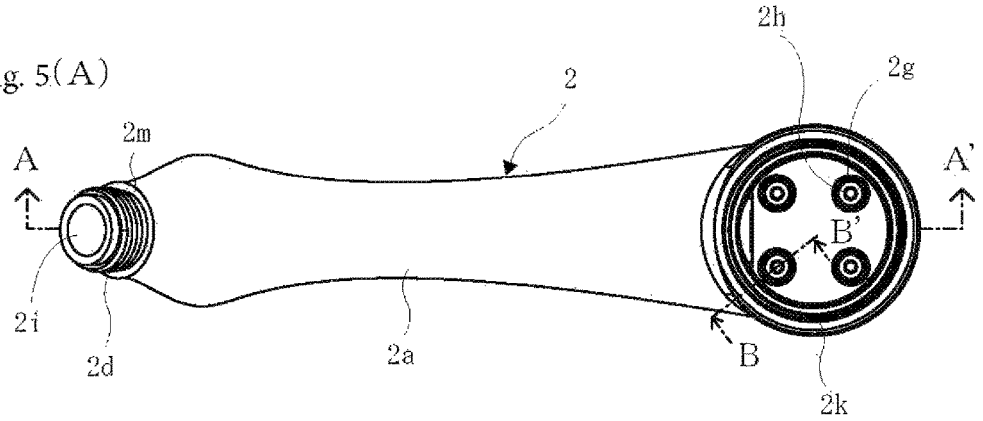
FIG. 5(A) is a front view of a body.

The present invention will be described in detail below with reference to the accompanying drawings. The present invention is not limited to embodiments described below.

[Embodiment 1]

As illustrated in FIGS. 1 to 12, a shower head 1 capable of providing a shower feeling without a water spray plate according to the present invention includes a body 2, the bottom plate 3, the tornado plate 4, the pressing plate 5, the micro bubble generator 6, and the cap 7. The bottom plate 3 and the tornado plate 4 may be integrally formed, and the pressing plate 5 and the micro bubble generator 6 may be integrally formed.

However, when these components are separately provided and assembled, the tornado plate 4 can be replaced with that having a preferable helical angle, and the flow path of the micro bubble generator can be changed, depending on tap water pressure. Other components can be common components, and thus a manufacturing cost can be reduced. Accordingly, a highly general-purposed micro bubble generating shower head can be provided.

Figure 5B:
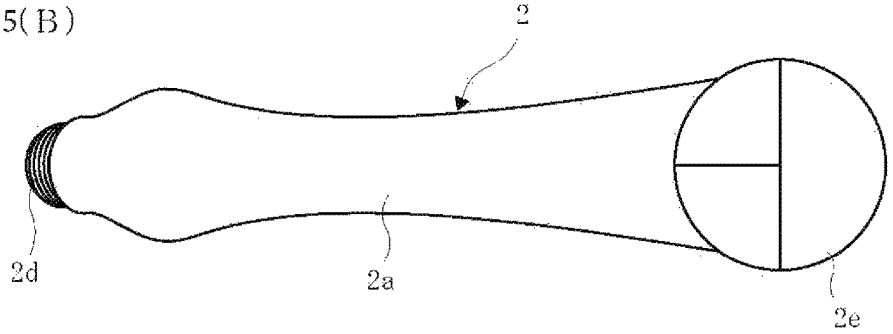
FIG. 5(B) is a back view of the body.
Figure 5C:
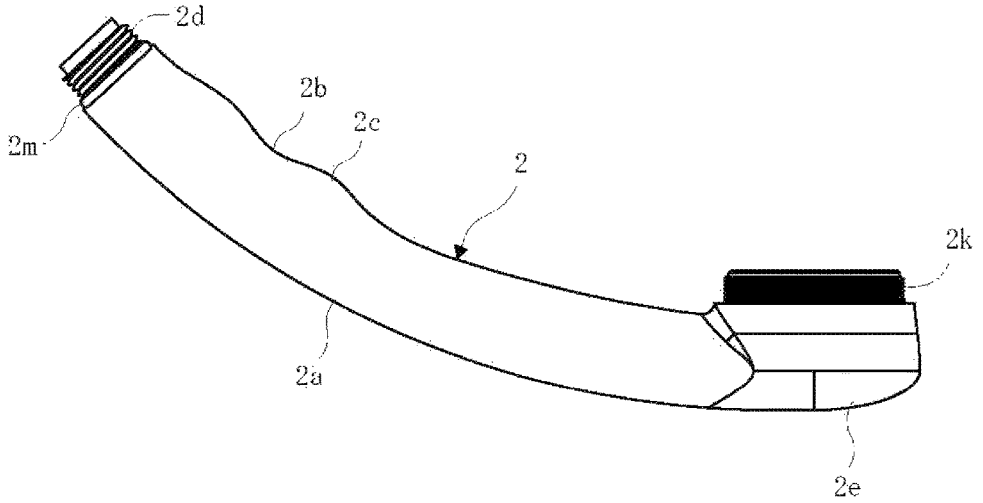
FIG. 5(C) is a right side view of the body.
Figure 6A:
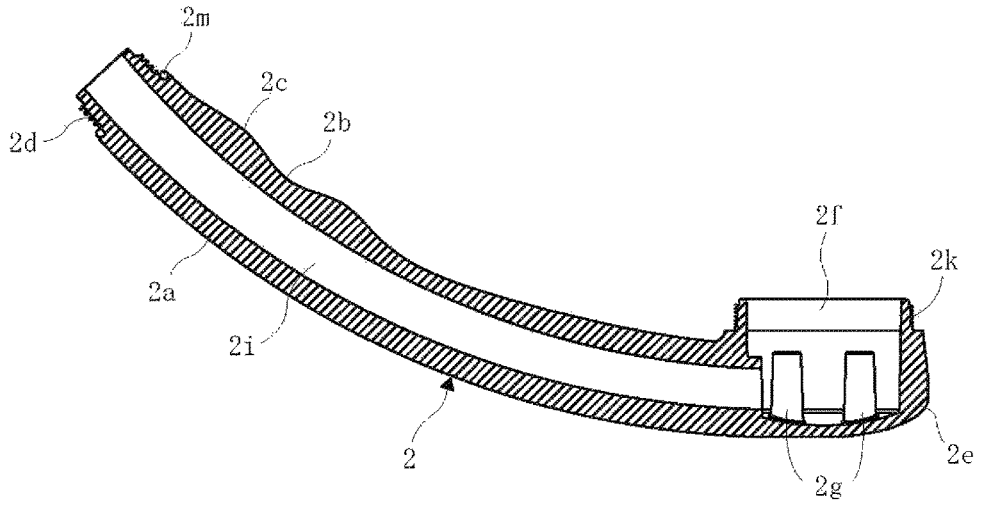
FIG. 6(A) is a sectional view taken along line A-A' in FIG. 5.
Figure 6B:
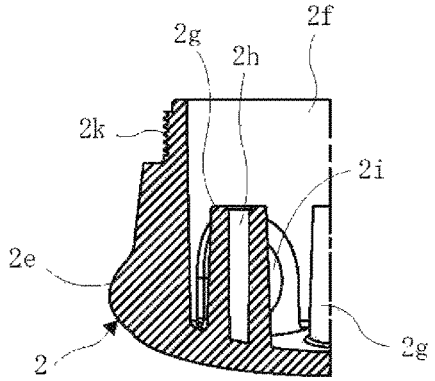
FIG. 6(B) is a sectional view taken along B-B' in FIG. 5.
Figure 7A:
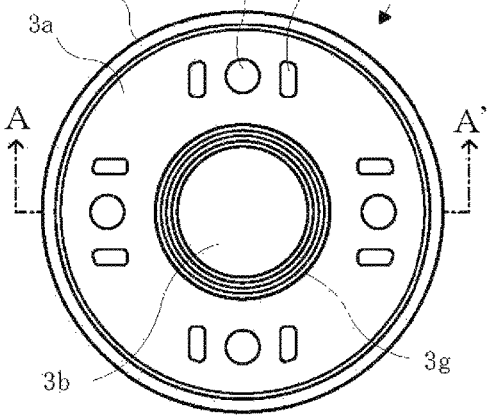
FIG. 7(A) is a front view of a bottom plate.
Figure 7B:
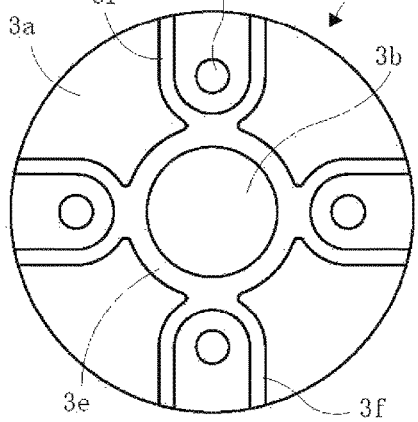
FIG. 7(B) is a back view of the bottom plate.
Figure 7C:
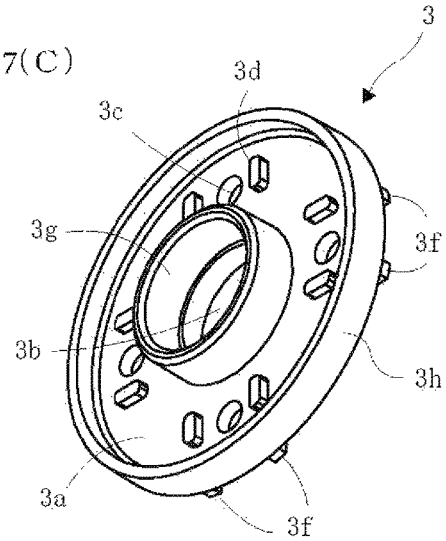
FIG. 7(C) is a front perspective view of the bottom plate.
Figure 7D:
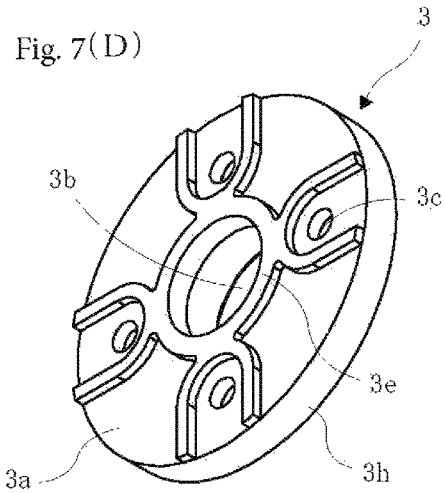
FIG. 7(D) is a back perspective view of the bottom plate.
Figure 7E:
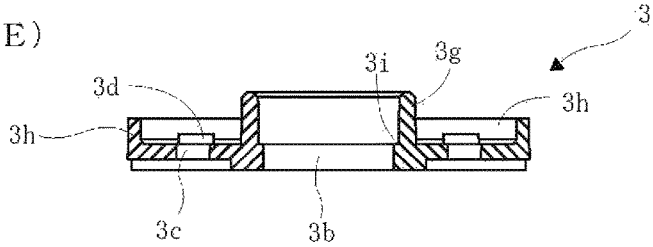
FIG. 7(E) is a sectional view taken along line A-A' in FIG. 7(A).

As illustrated mainly in FIGS. 5 and 6, the body 2 includes: the holding unit 2*a* suitable for holding by a hand; a first screw part 2*d* connected, by screwing, with a hose (not illustrated) through which tap water flows at one end of the holding unit 2*a* ; the head unit 2*e* disposed at the other end of the holding unit 2*a* , including an opening 2*f* facing substantially at right angle to the holding unit 2*a* , and including a second screw part 2*k* at an outer periphery; a flow path 2*i* communicated from an end part of the first screw part 2*d* to the opening 2*f* through inside of the holding unit 2*a* and the head unit 2*e;* and a plurality of protrusions 2*g* each protruding from a bottom part of the head unit 2*e* and including a screw hole 2*h* inside.

A packing 2*m* is fitted to the first screw part 2*d*, sealing a connection part with the hose. The holding unit 2*a* is suitable for holding and is provided with concavo-convex portions 2*b* and 2*c* serving as slip-proof portions.

As illustrated mainly in FIG. 7, the bottom plate 3 includes: a disk-shaped bottom part 3*a* including a through-hole 3*c* placed above each protrusion 2*g* of the head unit 2*e* and corresponding to the screw hole 2*h* of the protrusion 2*g;* a tubular inner rim 3*g* erected on an upper surface of the bottom part 3*a* , including a flow path 3*b* at a central part, and including inside a stepped portion 3*i* including a larger upper part and a smaller lower part; and an outer rim 3*h* erected at an outer periphery of the bottom part 3*a*.

Protrusions 3*d* protrude on right and left sides of the through-hole 3*c* on the upper surface of the bottom part 3*a*, providing the strength of the bottom part 3*a*. In addition, a first ridge 3*e* circularly surrounding a bottom part of the inner rim 3*g* , and a second ridge 3*f* connected with the first ridge 3*e* and having a U shape surrounding the through-hole 3c are provided on a bottom surface of the bottom part 3a to prevent distortion of the bottom part 3a when the bottom plate 3 is removed from a mold after molding.

The tornado plate 4 is housed in a portion having a larger diameter above the stepped portion 3i of the bottom plate 3 and locked by the stepped portion 3i. Then, as illustrated in, for example, FIGS. 3 and 4, the pressing plate 5 on which the micro bubble generator 6 is mounted is fitted to the bottom part 3a between the inner rim 3g and the outer rim 3h on the upper surface of the bottom part 3a , and is fixed to the protrusions 2g inside the head unit 2e by a fastener 2n.

Figure 8A:
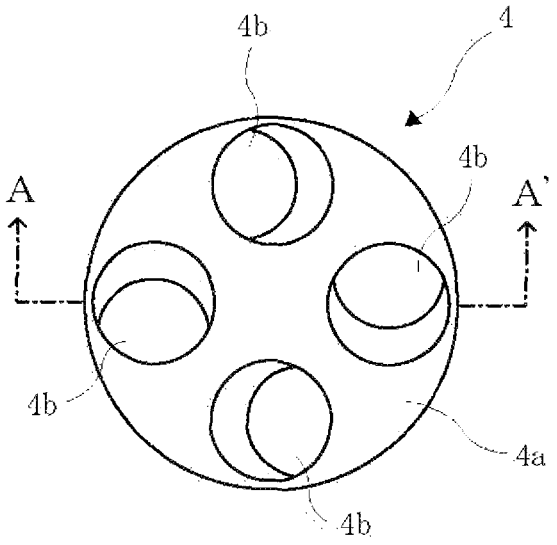
FIG. 8(A) is a front view a tornado plate.
Figure 8B:
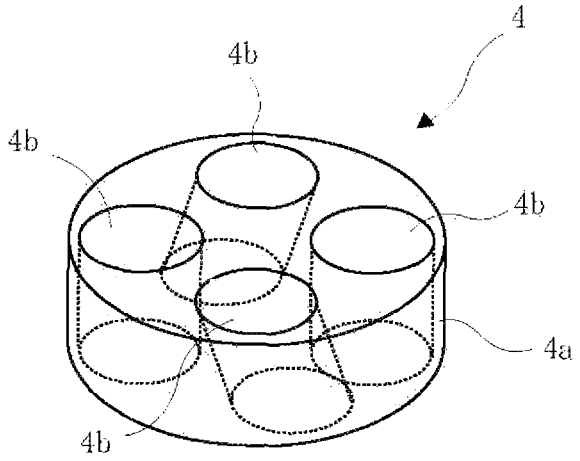
FIG. 8(B) is a perspective view of the tornado plate.
Figure 8C:
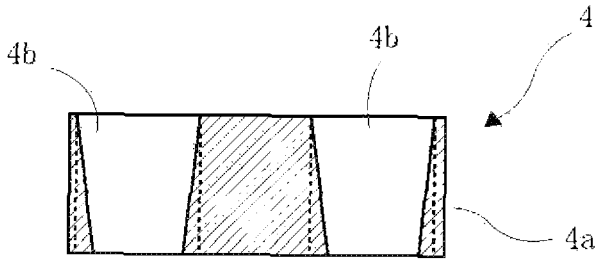
FIG. 8(C) is a sectional view taken along line A-A' in FIG. 8(A).
Figure 9A:
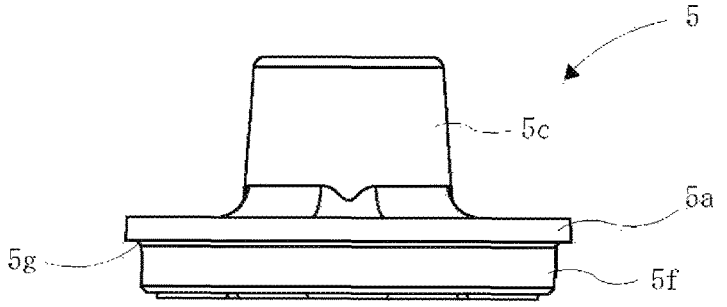
FIG. 9(A) is a left side view.
Figure 9B:
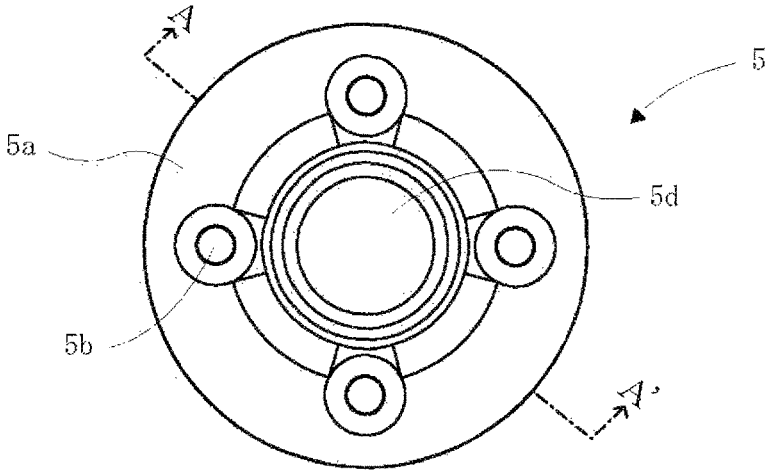
FIG. 9(B) is a front view.
Figure 9C:
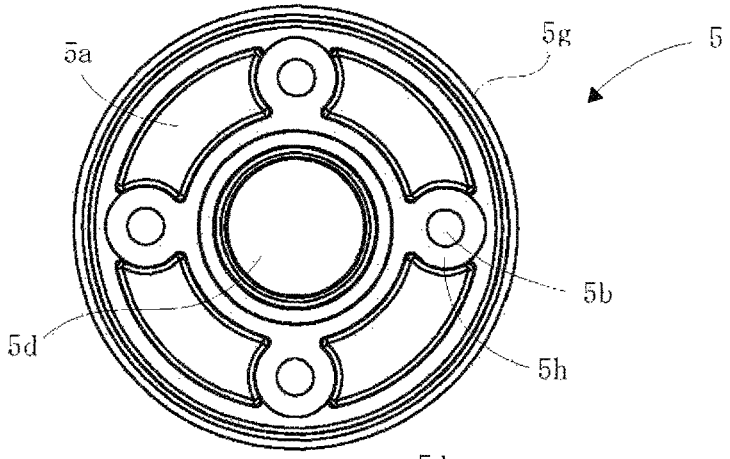
FIG. 9(C) is a back view.
Figure 9D:
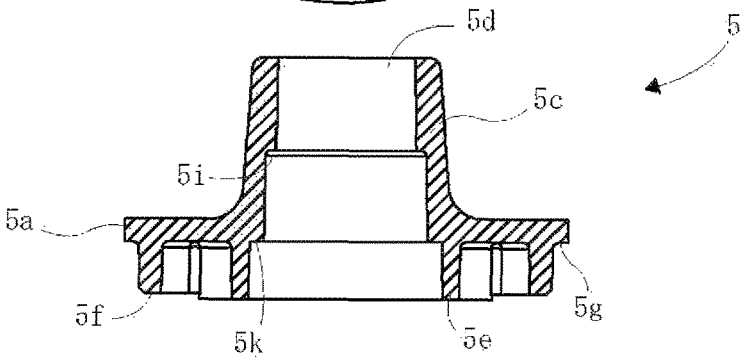
FIG. 9(D) is a sectional view taken along line A-A' in FIG. 9(A).

As illustrated mainly in FIG. 8, the tornado plate 4 includes a disk-shaped body 4a , and four holes 4b vertically penetrating through the body 4a and eccentrically extending at, for example, 15 [degrees] to generate swirling flow by applying rotation to tap water and achieve an increased flow speed. The body 4a may be formed of, for example, resin by molding. The tornado plate 4 is locked to the stepped portion 3i inside the inner rim 3g of the bottom plate 3 and fitted inside the bottom plate 3.

Figure 10A:
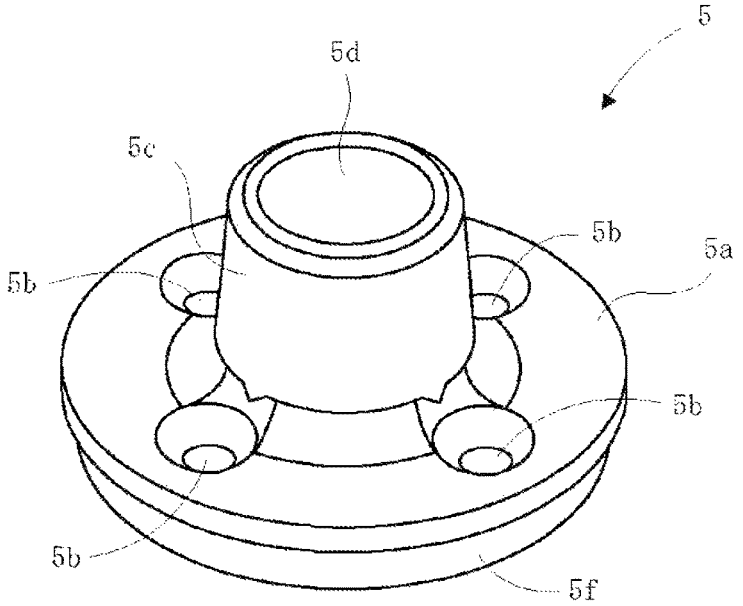
FIG. 10(A) is a front perspective view.
Figure 10B:
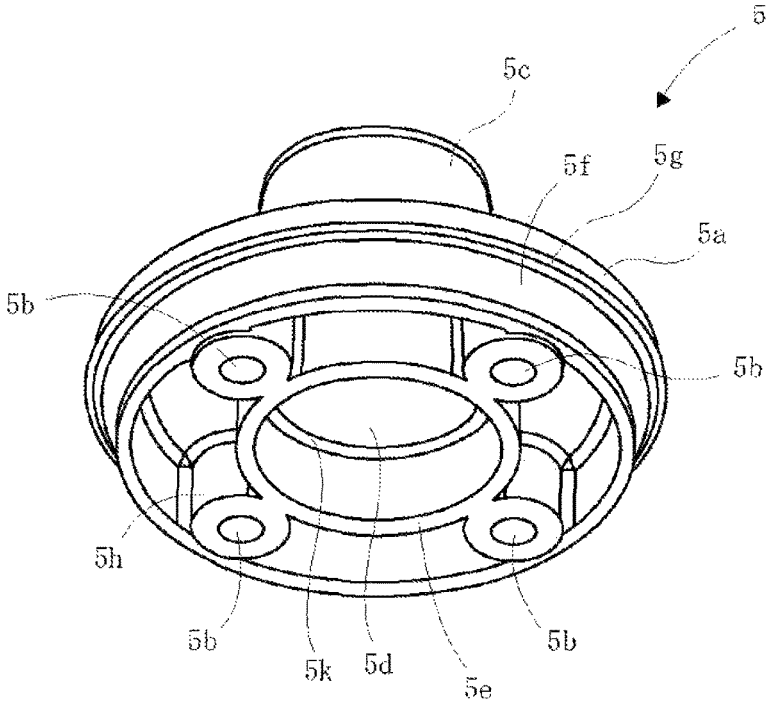
FIG. 10(B) is a back perspective view.
Figure 11A:
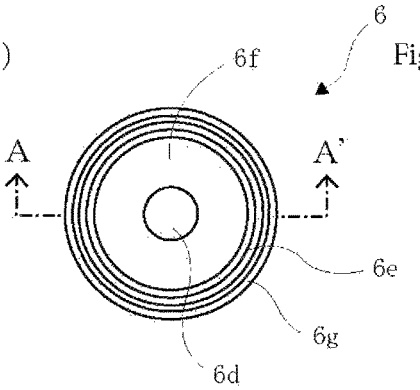
FIG. 11(A) is a front view.
Figure 11B:
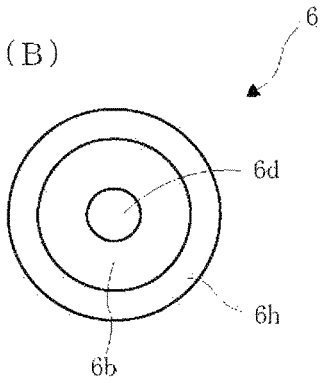
FIG. 11(B) is a back view.
Figure 11C:
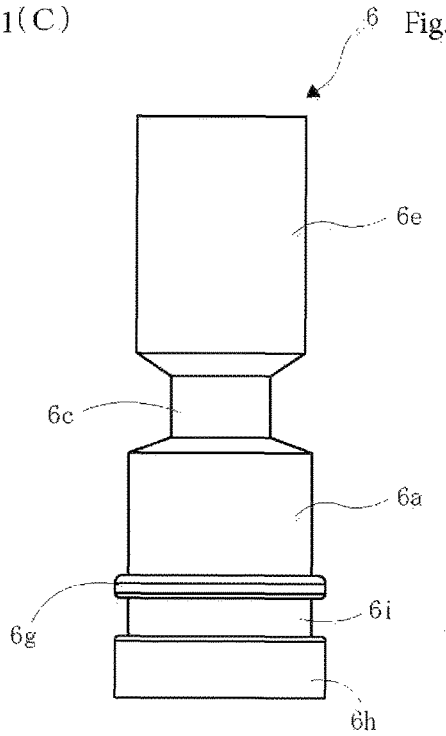
FIG. 11(C) is a left side view.
Figure 11D:
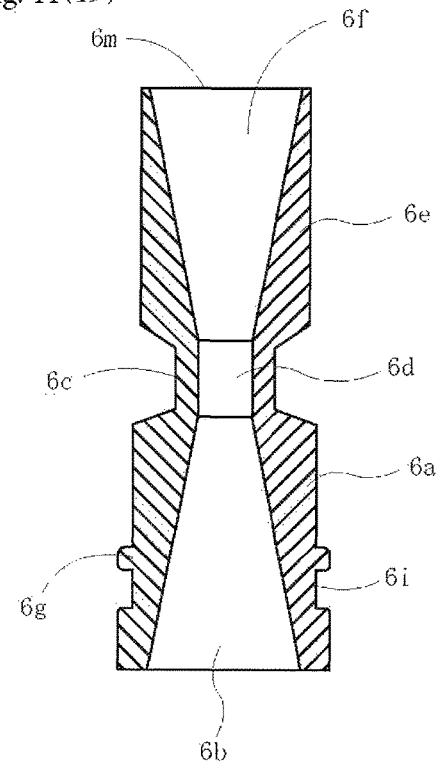
FIG. 11(D) is a sectional view taken along line A-A' in FIG. 11(A).

As illustrated mainly in FIGS. 9 and 10, the pressing plate 5 includes a through-hole 5b corresponding to the through-hole 3c of the bottom plate 3 and the screw hole 2h of the protrusion 2g of the head unit 2e , a disk-shaped plate portion 5a including a hole 5d at a central part, a cylindrical portion 5c erected at a central part of an upper surface of the plate portion 5a and including the hole 5d and a first inner stepped portion 5i inside, an inner rim 5e erected and forming a second inner stepped portion 5k around the hole 5d on a bottom surface of the plate portion 5a , an outer rim 5f erected and forming a stepped portion 5g at an outer periphery of the bottom surface of the plate portion 5a, and a ridge 5h erected around the through-hole 5b and protruding to a height same as that of the outer rim 5f. The ridge 5h forms the through-hole 5b , maintaining strength there.

As illustrated in FIGS. 3 and 4, a first ridge 6g of the micro bubble generator 6 is locked to the first inner stepped portion 5i . As illustrated in FIGS. 3 and 4, the inner rim 3g of the bottom plate 3 is locked to the second inner stepped portion 5k . The inner rim 5e and the outer rim 5f are fitted to the bottom part 3a of the bottom plate 3. As illustrated in FIGS. 3 and 4, the packing 5m is fitted to the stepped portion 5g, sealing a gap between the pressing plate 5 and the head unit 2e.

As illustrated mainly in FIG. 11, the micro bubble generator 6 includes: a first cylindrical portion 6a housed inside the hole 5d of the pressing plate 5, including a first flow path 6b having an inner diameter gradually decreasing toward a central part from an end part through which tap water enters, and provided with, on an outer circumferential surface, a second ridge 6h at the end part, the first ridge 6g closer to the central part than the second ridge 6h , and a groove 6i as a recess between the second ridge 6h and the first ridge 6g; a second cylindrical portion 6c including a second flow path 6d connected with the first flow path 6b ; and a third cylindrical portion 6e including a third flow path 6f connected with the second flow path 6d and having an inner diameter gradually increasing toward an end part through which the tap water exits, the end part serving as the spray nozzle 6m through which the tap water is discharged as a shower.

As illustrated in FIGS. 3 and 4, the first ridge 6g is locked to the first inner stepped portion 5i of the pressing plate 5, and the packing 6k is fitted to the groove 6i , sealing a gap between the pressing plate 5 and the micro bubble generator 6.

The tornado plate 4 is locked to the second ridge 6h, and the pressing plate 5 is fixed to the screw hole 2h of the protrusion 2g of the head unit 2e by the fastener 2n, thereby fixing the positions of the micro bubble generator 6 and the tornado plate 4.

The tap water discharged from the spray nozzle 6m is formed into a shower or spray form along the shapes of the tornado plate 4 and the micro bubble generator 6 without a water spray plate, allowing a user to obtain a shower feeling similarly to that obtained from typical shower water.

Figure 12A:
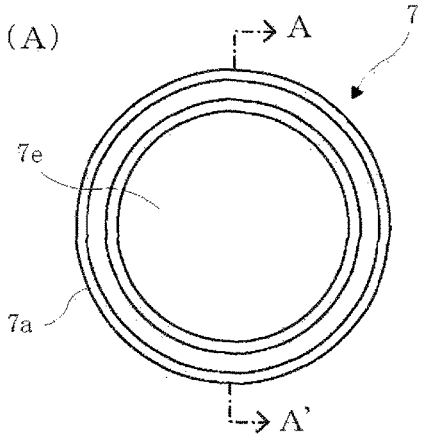
FIG. 12(A) is a front view.
Figure 12:
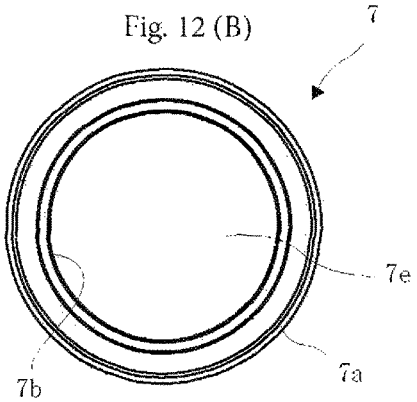
FIG. 12(B) is a back view.
FIG. 12(C) is a left side view.
FIG. 12(D) is a sectional view taken along line A-A' in FIG. 12(A)
FIG. 12(E) is a front perspective view.
FIG. 12(F) is a back perspective view.
Figure 12C:
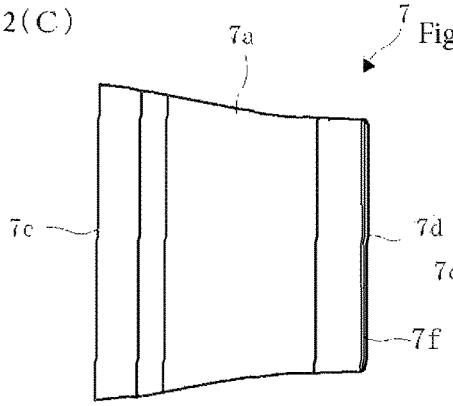
Figure 12D:
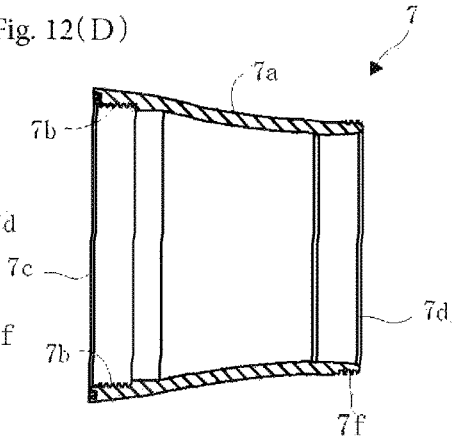
Figure 12E:
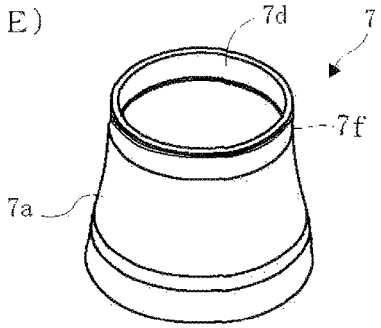
Figure 12F:
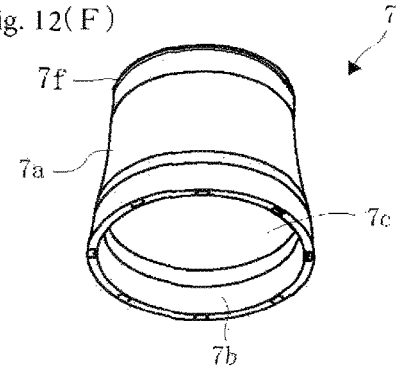

As illustrated mainly in FIG. 12, the cap 7 includes: a tubular body 7a including an internal hollow space 7e, and openings 7c and 7d at both ends, and having a smaller diameter toward a shower discharging side; a screw part 7b provided inside at one end on a side opposite to the discharging side; and a screw part 7f provided outside on the discharging side.

As illustrated in FIGS. 3 and 4, the screw part 7b is connected, by screwing, with the second screw part 2k of the head unit 2e of the body 2, and houses the micro bubble generator 6 in the internal hollow space 7e . The cap 7 has a length longer than that of the micro bubble generator 6. This configuration prevents the micro bubble generator 6 from causing injury by hitting the head of the user, or being damaged by hitting, for example, a floor.

With the above-described configuration, the shower head 1 capable of providing a shower feeling without a water spray plate is easy to hold, configured to generate micro bubbles from tap water without taking in external air and injecting the air into the tap water, pressurizing the tap water at high pressure, nor performing any other special processing for micro bubble generation, and is also easy to assemble.

The shower head according to the present application has such a structure that can provide a shower feeling without a water spray plate but allows attachment of a water spray plate in a case of high water supply pressure or in need of a weaker shower feeling.

Instead of a water spray plate, for example, a mesh net may be detachably fixed to a leading end part of the cap 7 by screwing to achieve a reduced shower pressure. For example, when a mesh net having a wire diameter of 20 and a pitch of 40 is attached, shower is discharged in droplets, not in lines, and a desirable micro bubble shower pressure can be obtained. Such a mesh net is usually not recognized as a water spray plate of a shower head.

REFERENCE SIGNS LIST 1 shower head capable of providing shower feeling without a water spray plate
2 body
2a holding unit
2b recess
2c convex portion
2d first screw part
2e head unit
2f opening
2g protrusion
2h screw hole
2i flow path
2k second screw part
2m packing
2n fastener
3 bottom plate
3a bottom part
3b flow path

3*c* through-hole
3*d* protrusion
3*e* first ridge
3*f* second ridge
3*g* inner rim
3*h* outer rim
3*i* stepped portion
4 tornado plate
4*a* body
4*b* hole
5 pressing plate
5*a* plate portion
5*b* through-hole
5*c* cylindrical portion
5*d* hole
5*e* inner rim
5*f* outer rim
5*g* stepped portion
5*h* ridge
5*i* first inner stepped portion
5*k* second inner stepped portion
5*m* packing
6 micro bubble generator
6*a* first cylindrical portion
6*b* first flow path
6*c* second cylindrical portion
6*d* second flow path
6*e* third cylindrical portion
6*f* third flow path
6*g* first ridge
6*h* second ridge
6*i* groove
6*k* packing
6*m* spray nozzle
7 cap
7*a* body
7*b* screw part
7*c* opening
7*d* opening
7*e* hollow space
7*f* screw part

The invention claimed is:

1. A shower head capable of providing a user with a shower feeling without a water spray plate, the shower head comprising:

a body that includes a head unit having one end connected with a hose through which tap water flows and including an opening formed at the other end, includes inside a flow path through which tap water flows, and is held by a hand;

a bottom plate fixed inside the head unit and including a hole at a central part;

a micro bubble generator placed on the bottom plate and including a micro bubble generating path formed inside;

a tornado plate positioned between the bottom plate and the micro bubble generator and including an eccentric hole configured to achieve an increased flow speed by swirling the tap water;

a pressing plate housing the micro bubble generator and fixed inside the head unit together with the bottom plate; and a tubular cap fitted to the opening of the head unit and housing the micro bubble generator inside, wherein the bottom plate includes a disk-shaped bottom part, a tubular inner rim erected on an upper surface of the bottom part and including a flow path at a central part and a stepped portion inside, and an outer rim erected on an outer periphery of the bottom part, and an end part of the pressing plate is positioned between the inner rim and the outer rim, and the tornado plate is fitted inside the flow path and locked by the stepped portion.

2. The shower head capable of providing a user with a shower feeling without a water spray plate according to claim 1, wherein the cap has a length longer than the length of the micro bubble generator.

3. The shower head capable of providing a user with a shower feeling without a water spray plate according to claim 1, wherein:

the micro bubble generator includes:

a first cylindrical portion housed in a hole of the pressing plate, and including a first flow path having an inner diameter gradually decreasing toward a central part from an end part through which the tap water enters, and provided with, on an outer circumferential surface, a second ridge at the end part, a first ridge closer to the central part than the second ridge, and a groove as a recess between the second ridge and the first ridge, a second cylindrical portion including a second flow path connected with the first flow path, and a third cylindrical portion including a third flow path connected with the second flow path and having an inner diameter gradually increasing toward an end part through which the tap water exits, the end part serving as a spray nozzle through which the tap water is discharged as a shower, the first ridge is locked inside the pressing plate, the groove is provided with a packing, and a gap between the pressing plate and the micro bubble generator is sealed.

4. The shower head capable of providing a user with a shower feeling without a water spray plate according to claim 3, wherein the tornado plate is fixed in position by being pressed by a second ridge end part of the micro bubble generator.

* * * * *